United States Patent [19]

Naeser et al.

[11] 4,182,263

[45] Jan. 8, 1980

[54] DEVICE FOR FEEDING FUSER OIL TO THE SURFACE OF A FIXING ROLLER

[75] Inventors: Helmut Naeser; Norbert Mendisch, both of Munich, Fed. Rep. of Germany

[73] Assignee: Siemens Aktiengesellschaft, Berlin & Munich, Fed. Rep. of Germany

[21] Appl. No.: 851,889

[22] Filed: Nov. 16, 1977

[30] Foreign Application Priority Data

Jan. 27, 1977 [DE] Fed. Rep. of Germany ..... 2703382

[51] Int. Cl.[2] ..... B05C 11/00; G03G 13/20; G03G 15/20

[52] U.S. Cl. ..... 118/60; 118/101; 118/260

[58] Field of Search ..... 118/60, 260, 257, 268, 118/266, 267, 70, 101; 432/60, 228; 427/22; 15/256.51; 355/3 FU

[56] References Cited

U.S. PATENT DOCUMENTS

| | | | |
|---|---|---|---|
| 3,324,791 | 6/1967 | Cassano et al. | |
| 3,427,840 | 2/1969 | Richter | 118/266 X |
| 3,515,855 | 6/1970 | Mix, Jr. | |
| 3,941,558 | 3/1976 | Takiguchi | 432/60 |
| 4,056,706 | 11/1977 | Strella | 432/60 X |

FOREIGN PATENT DOCUMENTS

| | | | |
|---|---|---|---|
| 1399740 | 7/1975 | United Kingdom | 355/3 FU |

*Primary Examiner*—John P. McIntosh

*Attorney, Agent, or Firm*—Hill, Van Santen, Steadman, Chiara & Simpson

[57] ABSTRACT

An applicator mechanism for applying fuser oil to a fixing roller of an electrostatic copying device includes an apparatus for supplying the oil to a first wick means, or to selected portions thereof. A second wick means includes a web interposed between the first wick means and the roller. The web is movable between take-up and supply reels.

10 Claims, 2 Drawing Figures

DEVICE FOR FEEDING FUSER OIL TO THE SURFACE OF A FIXING ROLLER

BACKGROUND OF THE INVENTION

1. Field of the Invention

This invention relates to electrostatic copier devices and more particularly to a fuser oil application mechanism for fixing stations of such devices.

2. Prior Art

Machines which work on electrostatic principles such as electrostatic copiers or printers are generally well known to the art. See for example U.S. Pat. No. 3,515,855. Such copiers or printers, can operate either by electrographic or electrophotographic principles. In electrophotographically operating devices a latent image charge pattern of the symbol or image to be reproduced or printed is generated on an intermediate carrier. The intermediate carrier may be a photoelectrically coated drum. Thereafter portions of the charge surface of the intermediate carrier are partially or totally discharged by exposure to produce the latent image. The latent image is then developed at a developing station in which the discharged zones of the intermediate carrier surface are coated with toner to produce a toner image. The toner image is then transferred from the intermediate carrier to a recording carrier at a transfer station. The recording carrier may be a sheet of paper or a paper web.

The toner images must thereafter be fused to the recording carrier at a fixing station.

Charge patterns can also be produced by the electrographic principle such as with the aid of electrode combs. Further it is known to generate the charge pattern directly on the recording carrier thereby eliminating the intermediate carrier. Finally it is also possible to produce toner images directly on the recording carrier. In all of these methods, it is necessary, or desirable, to fix the toner image on the recording carrier so as to make the image unblurable.

Designs for such fixing stations are known such as, for example that shown in U.S. Pat. No. 3,324,791. In that construction the fixing station consists of two fixing rollers between which the recording carrier carrying the toner image is passed. One of the rollers is heated. The heated roller generally contacts the side of the recording carrier containing the toner image. That heated roller is herein called the fixing roller. The other roller presses the recording carrier against the fixing roller. The toner image is fused onto the recording carrier by the application of heat and pressure from the rollers or cylinders.

One disadvantage with fixing devices of this type is that some toner and/or other debris may adhere to and remain on the surface of the fixing roller. In order to prevent depositation of toner particles on the fixing roller a fuser oil, generally a silicon oil, is applied to the fixing roller surface. Application of the fuser oil can be by means of a wick arrangement. A design for such a wick arrangement is shown in U.S. Pat. No. 3,324,791. In that construction a fuser oil roller dips into a container of fuser oil. The roller transfers fuser oil from the container to a wick which has a portion thereof contacting the surface of the fuser oil roller and another portion riding on the surface of the fixing roller. The fuser oil is thus transferred from the surface of the fuser oil roller to the surface of the fixing roller by the wick.

A disadvantage of this type of arrangement arises from the fact that dispite the application of the fuser oil to the fixing roller surface, it is impossible to totally eliminate deposit of paper dust or toner particles on that surface. With prolonged use of the fixing station, those deposits will be, at least in part, transferred to the wick thereby making the wick dirty. As a result the wick must be changed. It can become necessary to change the wick relatively frequently particularly when high fixing speeds are utilized.

Another disadvantage of the prior art wick arrangements is the fact that the wick extends over the entire axial extent of the fixing roller and it is not possible to coat isolated axial areas or zones of the fixing roller surface. However, since the fixing roller may have a maximum recording carrier contact length which is determined by the maximum width of the recording carrier being used in the device, when narrower recording carriers are used, this results in a waste of fuser oil to coat portions of the fixing roller which will not be in contact with the narrower data carrier.

It would therefore be an advance in the art to provide a construction which substantially reduces the necessity of changing the wick to replace a dirty wick and which further allows the fixing surface to be coated with fuser oil only in those areas which are subject to contact with the particular width of data carrier then being used in the machine.

SUMMARY OF THE INVENTION

It is therefore a principal object of this invention to provide a device for applying fuser oil to the surface of a fixing roller in which the wick does not have to be frequently changed and where partial coating of the axial length of the surface of the fixing roller can be accomplished.

This principal object is achieved by providing a fuser oil application device which includes at least one chamber supplied with fuser oil. The chamber has a first wick positioned adjacent thereto with a connection from the chamber to the wick for the purpose of supplying fuser oil to the wick. A second, movable, fixing roller contacting wick is interposed between the surface of the fixing roller to be coated and the first wick such that fuser oil will be passed from the first wick to the second wick and thence to the surface of the fixing roller.

Thus the second wick is interposed between the first or main wick and the fixing roller surface. The fuser oil passes from the chamber to the main wick and from the main wick to the second wick. The second wick may preferably be an elongated web which is wound off of a supply reel past the fixing roll and is taken up on a take-up reel. The take-up reel may be driven by a motor.

The fuser oil therefore passes from the chamber to the first wick and thence from the first wick to the second wick. The second wick applies a coating of fuser oil to the surface of the fixing roll while at the same time wiping any impurities from that surface in a manner which prevents the first wick from becoming soiled. By providing a generous supply of the second wick frequent changing of either of the wicks is eliminated thereby reducing service demands for the machine.

In the preferred embodiment, the direction of movement of the second wick from the supply reel to the take-up reel is opposite to the direction of rotation of the fixing roller. By this means toner particles or particles of paper dust which accummulate at the fixing roller nip will be continuously carried away by the second wick thereby preventing soiling of the fixing roller.

In order to adapt the coating of the fixing roller to the width of paper being used by the device, a plurality of fuser oil chambers can be aligned along the length of the fixing roller, with the chambers being positioned next to one another. The individual chambers can therefore be activated or deactivated such that fuser oil is only supplied to those chambers which are opposed to surface areas of the fixing roller which is desired to moisten with the fuser oil.

It is therefore an object of this invention to provide an improved fuser oil application device for use in fixing stations of electrostatic copying and printing machines.

It is another, and more specific object of this invention to provide a fuser oil application device for use in connection with fixing stations where fuser oil is supplied to a first wick which in turn supplies fuser oil to a second, moving wick, which contacts the fixing cylinder, the moving wick being a web supplied from a supply reel across the surface of the fixing roll to a take-up web.

It is another, and particular object of this invention to provide a fuser oil application device for use in connection with fixing stations wherein the device is capable of selectively applying fuser oil to all, or a part of the axial length of the surface of the fixing cylinder and where fuser oil is applied through the intermediary of a moving web wick.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
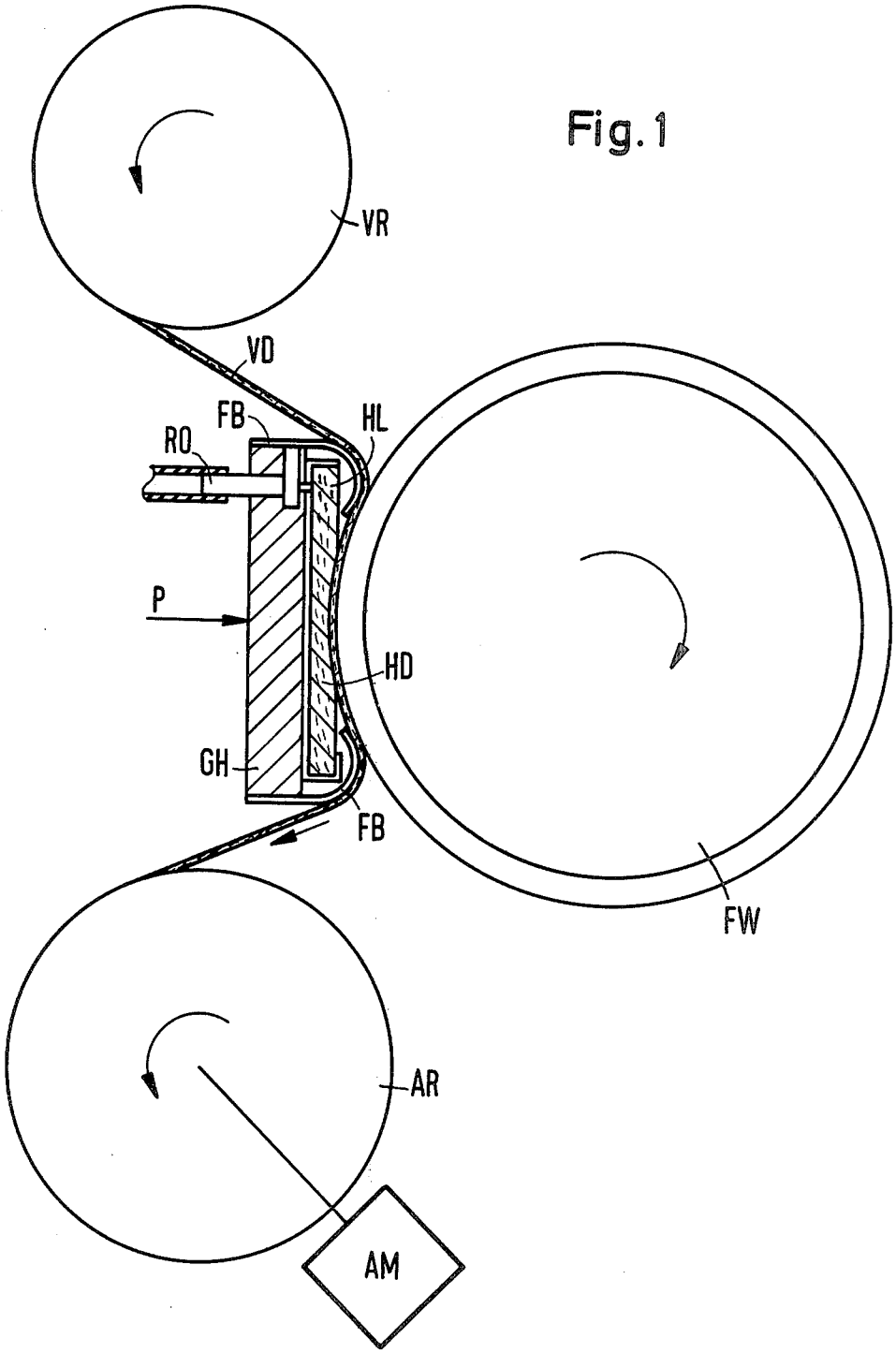
FIG. 1 diagrammatically illustrates, partially in cross section, a fuser oil application device according to this invention.

A portion of a toner fixing station for nonmechanical printers or copiers is illustration in FIG. 1. Since the design of the fixing station is known, for example, from U.S. Pat. No. 3,324,791 the teachings of which are herein incorporated by reference, remaining portions of the fixing station are not herein explained since they form no part of this invention. As shown in the drawing, the fixing station includes a fixer roller FW which may be heated. The fixer roller rotates in the direction indicated by the arrow therein.

A fuser oil application device utilizing a wick system is provided to moisten the surface of the fixing roll FW with a fuser oil which may, for example, be a silicon oil. A housing GH is provided having at least one chamber K therein for receipt of the fuser oil. The fuser oil is fed to the chamber K by means of a tube RO. The housing GH extends over the axial length of the roller FW.

Affixed to the housing GH is a mounting HL which receives a main or first wick HD. The wick may be made of felt. Between the chamber K and the main wick HD, chamber openings are provided through which fuser oil can be fed from the chamber to the wick HD. Whenever fuser oil is present in the chamber K the wick HD will suck up oil to the extent of saturation of the wick.

A movable second wick VD which may be of felt is positioned between the first wick HD and the surface of the fixing roller FW. The second wick is in contact both with the main wick and the roller surface. By means of this contact the fuser oil in the main wick can pass to the second wick VD and thence to the surface of the fixing roll FW.

To insure that the second wick VD will be applied against the surface of the roller, guide members FB are provided attached to the housing GH. The guides may be reverse bend arcuate spring fingers or the like with the second wick VD running over the guides and being pressed against the surface of the roller FW substantially as illustrated.

It is preferred to provide the second wick as a web which is supplied from a supply reel VR to a take-up reel AR. The reel AR may be driven by a motor AM. In a preferred embodiment the motor AM may be rotated at a constant speed during operation of the fixing device K to draw the second wick VD off of the supply reel VR and past the surface of the fixing roller FW. In the process of contacting and moving past the fixing roller, the second wick VD will carry off any accummulation of dirt or toner from the surface of the fixing roller and transport such debris to the take-up reel AR. In this, the second wick VD protects the wick HW and prevents it from becoming soiled. Since the supply of the second wick VD can be quite generous in comparison to the main wick, frequent changing of even the second wick VD will not be necessary.

Preferably the direction of movement of the second wick VD will be opposite to the direction of rotation of the fixing roller FW at the point of contact of the second wick and fixing roller. This will insure that dirt which arrives at the second wick by rotation of the fixing roller arrives at that portion of the second wick which will shortly thereafter be removed from contact with the fixing roller.

In order to maintain adequate contact between the fuser oil application device and the fixing roller, a force P acting in the direction of the arrow can urge the housing GH in the direction of the fixing roller. Reference is again made to U.S. Pat. No. 3,324,791 for a disclosure relative to the application of the force P.

Figure 2:
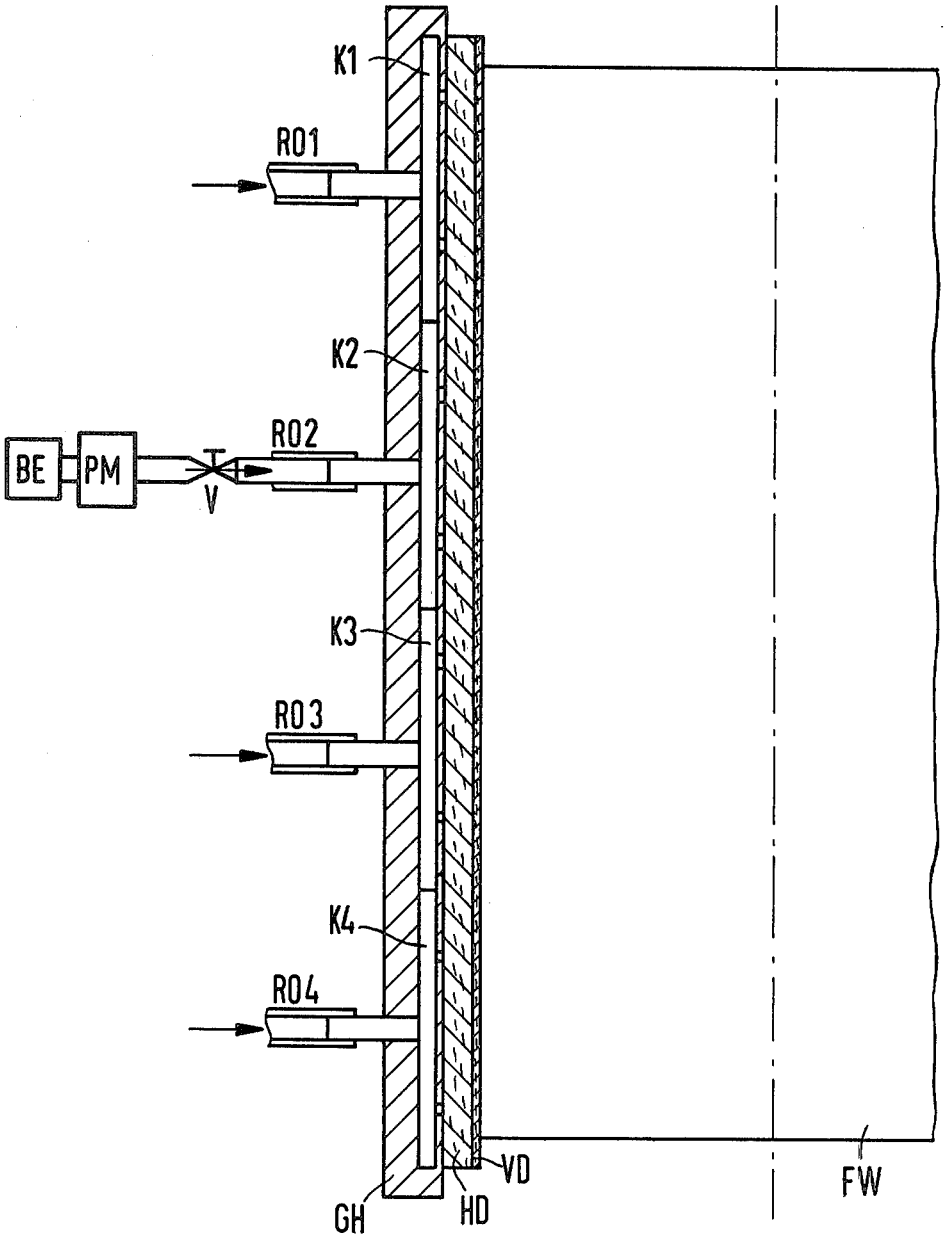
FIG. 2 illustrates the fuser oil application device, partially in horizontal section.

FIG. 2 illustrates a horizontal section through the housing GH and also shows a portion of the fixing roller FW. From this view it can be seen that the housing GH, the first wick HD and the second wick VD all extend over the full axial length of the roller FW. Further, preferably the first wick HD has a greater cross-section thickness than the second wick VD thus insuring an adequate supply fuser oil to the second wick VD and the surface of the fixing roll FW.

As also shown in FIG. 2, the chamber K can be subdivided into more than one chamber along the length of the fixing roller FW. For example, FIG. 2 illustrates 4 such chambers positioned next to one another and separated from one another by dividing walls. Each chamber K1 to K4 can be supplied with fuser oil from separate supply lines RO1 to RO4. By providing for control of the lines RO1 to RO4, it is possible for fuser oil to be supplied only to designated chambers according to the width of the recording carrier being used. For example, when a narrow recording carrier is being used, fuser oil may be fed only to chambers K2 and K3. This positioning of adjacent aligned independent chambers thus makes it possible to provide fuser oil only to those areas of the length of the fixing roll where it is required.

The fuser oil can be supplied to the chambers K in a known manner. For example the connectors RO can be linked to a pump PM through valves V. The pump PM can then draw fuser oil from a storage container BE and pump it to the chambers K1 through K4. The supply of fuser oil to the individual subchambers can be controlled by individual valves V for each of the supply lines RO1 through RO4. Since the construction of the pump and fuser oil storage forms no part of this invention, it is only diagrammatically illustrated in FIG. 2.

It is to be noted that each of the chambers K1 through K4 has its own exit apertures to the first wick HD such that substantially only the axial portion of the wick HD which overlies the chambers K1 through K4 will be wetted when the individual chambers are activated and adjacent chambers are deactivated.

It can therefore be seen from the above that this invention provides a new fuser oil application device for use in connection with fixing stations of electrostatic copiers and printers. The fuser oil application device includes a main wick and a second wick with the second wick formed as a moving web and interposed between the main wick and the fixing roller such that contaminants removed from the fixing roller surface by the second wick will be moved away from the fixing roll to a web take-up.

Further the invention provides for wetting of only selected portions of the axial length of the fixer roll.

Although the teachings of our invention have herein been discussed with reference to specific theories and embodiments, it is to be understood that these are by way of illustration only and that others may wish to utilize our invention in different designs or applications.

We claim as our invention:

1. In a device for feeding fuser oil to the surface of a fixing roller in a toner image fixing station of an electrostatic device where fuser oil is transferred to a surface of the fixing roller through the intermediary of a wick, the improvement of a first wick adjacent to the surface of the fixing roller, a chamber defining member supplying fuser oil to the side of the first wick opposite to the fixing roller, a movable second wick interposed between the first wick and the surface of the fixing roller, the first wick effective to supply fuser oil to the second wick, the second wick effective to supply fuser oil to the surface of said fixing roller, and means moving said second wick past the first wick and surface of said fixing roller in contact with said surface.

2. The device according to claim 1 wherein the second wick is a web member drawn from a supply reel past the fixing roller to a take-up reel.

3. The device of claim 2 wherein the take-up reel is motor driven at a constant speed during operation of the fixing roller.

4. A device according to claim 2 wherein the direction of movement of the second wick is opposite to the direction of rotation of the fixing roller at the point of contact of the second wick and the fixing roller surface.

5. A device according to claim 1 wherein the chamber is provided in a housing member, the housing member extending axially of the fixing roller at least along the length of the fixing roll contactable with a recording carrier having toner images thereon to be fixed at the fixing station, the housing including a mounting attaching the first wick to the housing, guide members positioned at longitudinal sides of the housing and attached thereto, the guide members guiding the second wick across the surface of the fixing roller, the guide members effective to press the second wick against the said surface.

6. A device according to claim 1 wherein a plurality of fuser oil supplying chambers are provided next to one another for substantially the length of the fixing roll, the chambers divided from one another, each chamber having an opening extending along the portion of the width of the first wick and having means communicating the opening to the wick, each chamber individually supplying fuser oil to a selected portion of the first wick, and means controlling supply of fuser oil to the individual chambers.

7. A fuser oil application device for use in applying fuser oil to a surface of a fixing roller at a fixing station in a toner fixing operation, comprising: a housing member extending axially of the fixing roller adjacent thereto, the housing member having at least one fuser oil dispensing chamber therein, the housing having a first wick attached thereto, a means communicating the chamber to the first wick, a second wick interposed between the first wick and the surface of the fixing roller having portions contacting the roller surface, means moving the second wick past the first wick whereby the portions of the second wick contacting the surface can be changed.

8. The device of claim 7 wherein the second wick is a web supplied from a supply reel and taken up by a motor driven take-up reel, the web moving across the first wick, means associated with the housing urging the second wick into contact with the fixing roller surface and the first wick into contact with the second wick.

9. The device of claim 8 wherein a plurality of chambers are provided axially spaced substantially along the length of the fixer roller, each of the chambers being independently supplied with fuser oil, each of the chambers communicating with selected axial portions of the main wick whereby portions of the main wick, less than the entirety thereof, can be supplied with fuser oil while remaining portions thereof are left dry.

10. In a fuser oil supply means for supplying fuser oil to the surface of a fixing roller at a fixing station in an electrostatic printing device by wick means, the improvement of a first wick extending substantially the axial length of the fixing roll, a second wick in the form of a traveling web between the first wick and fixing roller in contact therewith, means for moving the second wick past the first wick, separate means supplying fuser oil to axially adjacent portions of the first wick, and means for controlling supply of fuser oil whereby portions of the first wick less than axial length of the wick can be supplied with fuser oil while remaining portions are not supplied with fuser oil to supply selected portions of the second wick with fuser oil whereby axially selected portions of the fixing roller may be wetted with fuser oil.

* * * * *